US005632713A

United States Patent [19]

Canning et al.

[11] Patent Number: 5,632,713

[45] Date of Patent: May 27, 1997

[54] APPARATUS AND METHOD FOR ERECTING BOXES

[76] Inventors: Timothy A. Canning, 5109 Sandlewood Dr., Raleigh, N.C. 27609; Andrew F. Hartman, Elgarstraat 16, 5653 AH Eindhoven, Netherlands; Ken Williams, 3523 Mill Run, Raleigh, N.C. 27612; Harry R. Elliot, 325 Valley Green Rd., Mauldin, S.C. 29662; Quentin J. Hendricks, 214 Lynnwood Dr., Knightdale, N.C. 27545

[21] Appl. No.: 336,979

[22] Filed: Nov. 10, 1994

[51] Int. Cl.[6] ..... B31B 1/26

[52] U.S. Cl. ..... 493/162; 493/137; 493/476

[58] Field of Search ..... 493/136, 137, 493/140, 162, 183, 243, 453, 458, 473, 405, 476, 478, 176, 904

[56] References Cited

U.S. PATENT DOCUMENTS

| | | | |
|---|---|---|---|
| 3,101,653 | 8/1963 | Burden | 493/140 |
| 3,385,177 | 5/1968 | Waterhouse | 493/162 |
| 3,521,530 | 7/1970 | Pierce | 493/137 |
| 3,521,536 | 7/1970 | Waldbauer et al. | 493/168 |
| 3,626,819 | 12/1971 | Hoyrup | 93/51 R |
| 3,797,370 | 3/1974 | Sawada | 93/51 HW |
| 3,913,466 | 10/1975 | Bayer et al. | 493/168 |
| 3,975,994 | 8/1976 | Nakane | 493/59 |
| 4,040,340 | 8/1977 | Iijima | 93/49 R |
| 4,052,933 | 10/1977 | Royal | 93/51 M |
| 4,173,173 | 11/1979 | Mims | 93/51 R |
| 4,220,076 | 9/1980 | Moen | 93/37 SP |
| 4,283,190 | 8/1981 | Williams et al. | 493/131 |
| 4,342,563 | 8/1982 | Campbell | 493/168 |
| 4,498,895 | 2/1985 | White | 493/476 |
| 4,926,615 | 5/1990 | Alexander | 53/564 |
| 5,059,165 | 10/1991 | Wallin | 493/137 |
| 5,156,583 | 10/1992 | Baas | 493/140 |
| 5,167,605 | 12/1992 | Wallin | 493/122 |
| 5,184,998 | 2/1993 | Volk | 493/176 |
| 5,190,278 | 3/1993 | Wallin | 271/147 |
| 5,402,620 | 4/1995 | Perobelli | 53/371.9 |
| 5,417,941 | 5/1995 | Warren | 493/405 |

*Primary Examiner*—Joseph J. Hail, III
*Assistant Examiner*—Christopher W. Day
*Attorney, Agent, or Firm*—Erwin Doerr

[57] ABSTRACT

An apparatus (10) is provided for erecting boxes from blanks (11) having sides panels (13) with three score lines (20, 22 and 24). The apparatus has a base plate (40), two side folding mechanisms (44) and two end folding mechanisms (45). The side folding mechanisms have a proximal plate (51) pivotally mounted to the base plate, an intermediary plate (53) pivotally mounted to the proximal plate, and a distal plate (55) pivotally mounted to the intermediary plate. Linkage (68) coupled to a handle (76) actuates the movement of the proximal, intermediary and distal plates.

9 Claims, 3 Drawing Sheets

APPARATUS AND METHOD FOR ERECTING BOXES

TECHNICAL FIELD

This invention relates to apparatuses and methods for erecting boxes from blanks having opposite side panels with three score lines.

BACKGROUND OF THE INVENTION

For many years, boxes have been erected from blanks which are die-cut and scored so that the blanks may be folded and interlocked to form the individual walls of the box. These blanks may be manually folded. However, blanks which must be folded a number of times are often difficult to manipulate manually by a single person. Hence, apparatuses have been developed to conduct the folding process of the blanks.

Automated box forming and packing apparatuses have been developed to form blanks into boxes and to pack the box with articles, as shown in U.S. Pat. No. 3,566,755. However, these types of apparatuses are inappropriate where space is limited and it is desired to form boxes occasionally as the need arises, for example within a retail store wherein the blanks are stored flat, to conserve space and erected into boxes only upon the purchase of merchandise. Additionally, as these types of apparatuses are typically built to form boxes as quickly as possible, they are typically expensive, complicated and difficult to use, and thus ill-suited for individual store use.

Automated box forming apparatuses have also been developed which form only the box, as shown in U.S. Pat. Nos. 3,101,653, 3,913,466, 3,975,994 and 5,184,998. Here again, however, the apparatuses are quite large and complicated to use, and thus ill-suited for individual store use.

Accordingly, it is seen that a need remains for a simple and compact apparatus for erecting boxes from blanks. It is to the provision of such therefore that the present invention is primarily directed.

SUMMARY OF THE INVENTION

In a preferred form of the invention an apparatus is provided for erecting boxes with double wall sides and base flaps from blanks having opposite side panels with three side score lines. The apparatus comprises a base having a top surface, oppositely disposed sides and oppositely disposed ends. The apparatus also has two side blank folding mechanisms mounted adjacent the base sides. Each blank folding mechanism has a proximal side plate mounted for pivotal movement aside the base, an intermediary side plate mounted for pivotal movement aside the proximal side plate, a distal side plate with a catch mounted for pivotal movement aside the intermediary side plate, and actuation means for pivoting the proximal side plate toward the base top surface, for pivoting the intermediary side plate toward the base top surface and into an overlapped configuration with the proximal side plate, and for pivoting the distal side plate away from the proximal side plate and the base top surface as the intermediary side plate nears the proximal side plate. With this construction, a blank placed upon the base has its side edges captured by the catches so that the blank sides may be formed through operation of the actuation means. This is done by folding the blank along first side score lines as the proximal side plates move toward the base, folding the blank along second side score lines so as to overlap itself as the intermediary side plates overlap the proximal side plates, and folding the blank along third side score lines to create a base flap as the intermediary side plates pass closely adjacent the base with the blank therebetween.

DETAILED DESCRIPTION

Figure 2:
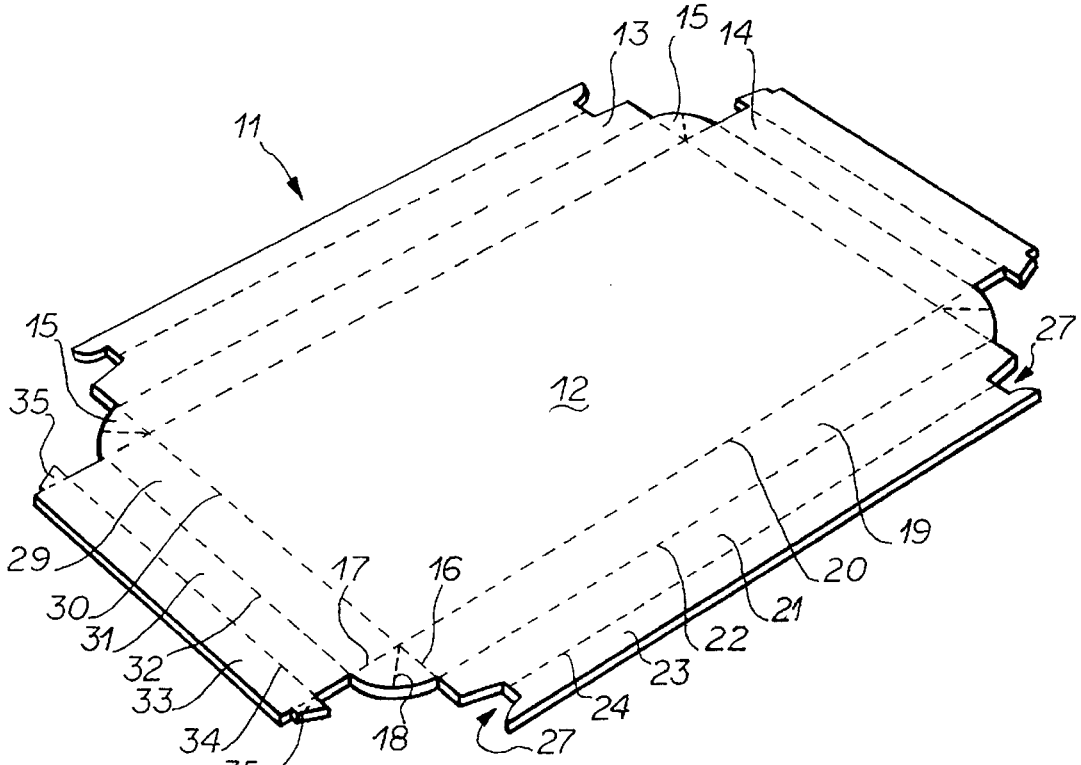
FIG. 2 is a perspective view of a blank from which the apparatus of FIG. 1 erects a box.

With reference next to the drawings, there is shown an apparatus 10 for erecting boxes, trays, tray covers or the like from blanks 11. The blanks 11 are of the type shown in U.S. Pat. No. 4,795,084 which is incorporated herein by reference. As shown in FIG. 2, the blank 11 has a central panel 12 bordered by side panels 13, end panels 14 and corner webs 15 extending from the side panels 13 along a fold lines 16 and from the end panels 14 along a fold lines 17. Each corner web 15 has a central fold line 18. It should be understood that herein the term fold lines is meant to include score lines, cut lines and perforation lines formed in the blank and subsequently the actual fold made upon the blank along such lines. Each side panel 13 has an outer side panel 19 foldably joined to the central panel along a first fold line 20, an inner side panel 21 foldably joined to the outer side panel 19 along a second fold line 22, and a side base flap 23 foldably joined to the inner side panel 21 along a third fold line 24. A notch 27 extends into each end of the inner side panel 21 and side base flap 23. Each end panel 14 has an outer end panel 29 foldably joined to the central panel along a fold line 30, an inner end panel 31 foldably joined to the outer end panel 29 along a fold line 32, and an end base flap 33 foldably joined to the inner end panel 31 along a fold line 34. Locking tabs 35, sized and shaped to be received within the notches 27 of the side panel 13, extend from opposite ends of the end base flaps 33.

The apparatus 10 has a rectangular base plate 40 having oppositely disposed sides 41 and oppositely disposed ends 42. Two side blank folding mechanisms 44 are mounted to the base plate 40 adjacent its sides 41, and two end blank folding mechanisms 45 are mounted to the base plate 40 adjacent its ends 42. The side blank folding mechanisms 44 are movable between an open configuration, shown in FIGS. 1 and 3 and closed configuration, shown in FIG. 6. Similarly, the end folding mechanisms 45 are movable between an open configuration, shown in FIGS. 1 and 3 and closed configuration, shown in FIG. 9. Four feet 47 support the base plate 40 above a supporting surface 48.

Each side blank folding mechanism 44 has a proximal plate 51 pivotally mounted to the base plate 40 by a hinge 52, an intermediary plate 53 pivotally mounted to the proximal plate 51 by a hinge 54, a distal plate 55 pivotally mounted to the intermediary plate 53 by a hinge 56, and actuation means 60 mounted to the base plate 40, the proximal plate 51, the intermediary plate 53 and the distal plate 55. The distal plate 55 has an elongated bar 61 which acts as a catch. The proximal plate 51 have an elongated slot 63 adjacent each of its ends through which extends a resilient projection such as the biasing spring 64 mounted to the proximal plates.

Figure 6:
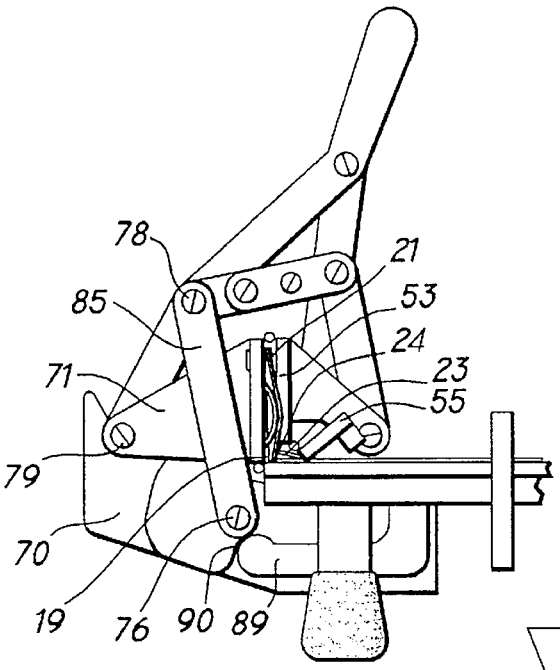

Each actuation means 60 is comprised of a handle 67 coupled to linkage 68 which controls the movement of the proximal, intermediary and distal plates 51, 53 and 55, respectively. The linkage 68 includes a pair of base links 70 mounted to bottom of the base plate 40, a mounting bracket 71 mounted to the proximal plate 51, a mounting bracket 72 mounted to the intermediary plate 53, and a mounting bracket 73 mounted to the distal plate 55. The linkage also has a jogged main link 75 contiguously extending from handle 67 and pivotally mounted to the base link 70 through a pivot pin 76. A V-shaped proximal link 77 is pivotally coupled at its bight to the main link 75 through a pivot pin 78, pivotally coupled at one end to the proximal plate mounting bracket 71 through a pivot pin 79, and pivotally coupled at its opposite end to one end of an intermediary link 81 through a pivot pin 82. The intermediary link 81 is coupled at its opposite end to the intermediary mounting bracket 72 through a pivot pin 83. An auxiliary link 85 is also pivotally mounted to pivot pins 76 and 78 for stabilization purposes. A distal link 86 is pivotally coupled at one end to main link 75, immediately below handle 67, through a pivot pin 87, and pivotally coupled at its opposite end to distal plate mounting bracket 73 through a pivot pin 88. As best shown in FIG. 6, a pawl 89 is mounted to the base plate so as to ride upon the main link 75 and nest within a detent 90 within the main link, with the linkage in a closed configuration.

Each end blank folding mechanism 45 has a proximal plate 91 pivotally mounted to the base plate 40 by a hinge 92 and a distal plate 93 pivotally mounted to the proximal plate 91 by a hinge 94. The proximal plate 91 has a notch 96 extending from each of its end. L-shaped support plates 95 are mounted to the bottom of the base plate 40 so as to support the proximal plates 91 and distal plates 93 in their open configuration and to help initially align the blank 11 upon the base plate 40.

Figure 1:
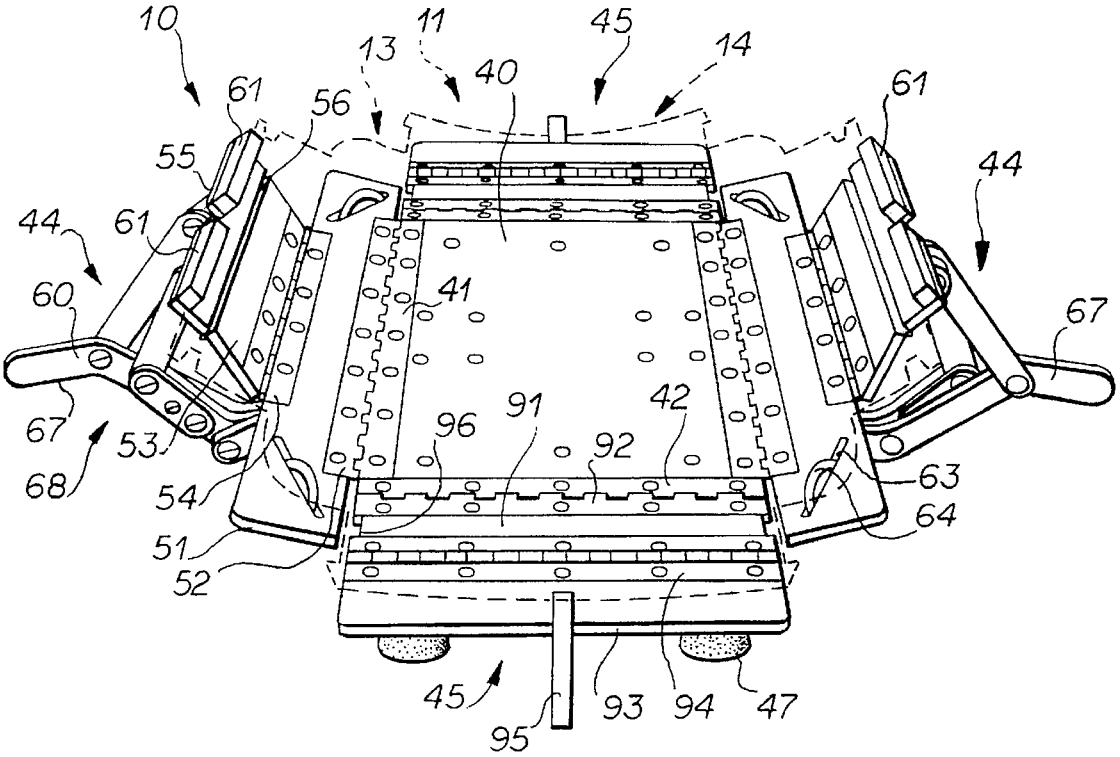
FIG. 1 is a perspective view of an apparatus for erecting boxes embodying principles of the invention in a preferred form.
Figure 3:
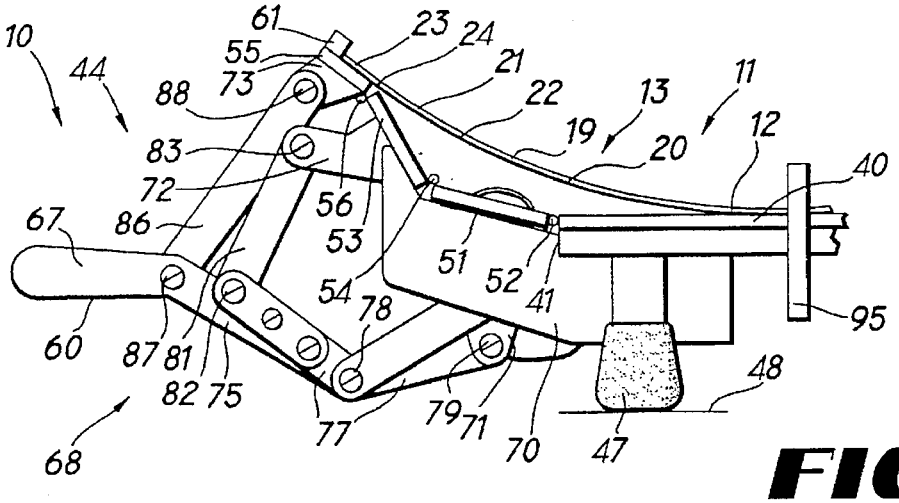
FIGS. 3–6 are a sequence of views of a portion of the apparatus of FIG. 1, with portions also removed for clarity, which show, in sequence, a blank side panel being folded by the apparatus.

In use, the side folding mechanisms 44 and the end folding mechanisms 45 are positioned in their open configuration. A blank 11 is positioned upon the apparatus 10 in a bowed shape with its side edges captured and retained by the elongated bars 61 of the distal plates 55, as shown in FIGS. 1 and 3. With the blank properly positioned upon the apparatus, the first fold lines 20 are positioned adjacent to and substantially parallel with hinges 52, the second fold lines 22 are positioned adjacent to and substantially parallel with hinges 54, and the third fold lines 24 are positioned adjacent to and substantially parallel with hinges 56. Similarly, the blank end fold lines 30 are positioned adjacent to and substantially parallel with hinges 92 and fold lines 32 are positioned adjacent to and substantially parallel with hinges 94.

Figure 4:
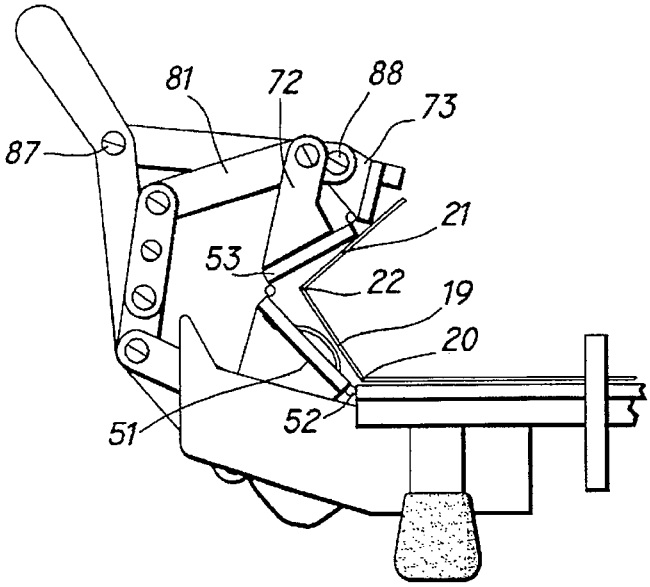

The side folding mechanisms 44 are initially actuated through the movement of the handles 67 toward each other. As shown in FIG. 4, this movement pivots the proximal plates 51 uprightly and towards the top surface of the base plate while simultaneously pivoting the intermediary plates 53 towards the proximal plates 51. The pivotal movement of the intermediary plates causes the blank to be folded along its second fold lines 22 and thereby captured between the intermediary plates and the proximal plates. The pivotal movement of the proximal plates 51 causes the blank to be folded along its first fold lines 20. Continued movement of the handles, and thereby the linkage, causes the distal plates 55 to pivot away from the base plate and release the side edges of the blank.

Figure 5:
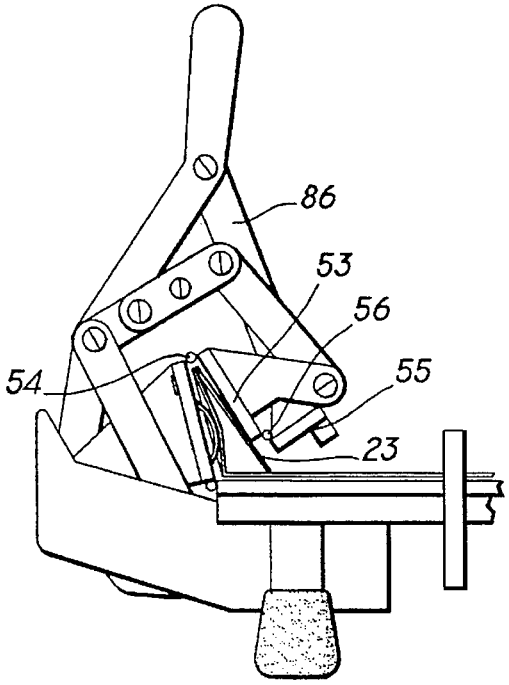

As shown in FIG. 5, the pivotal movement of the distal plates 55 allows the intermediary plates to pass closely adjacent the base plate 40 subsequent to the blank side edges contacting the blank central panel 12. The passing of the intermediary plates causes the blank sides 13 to be folded along their third fold lines 24 as they are wrapped about the intermediary plates with the blank side base flaps 23 forced between the intermediary plates and the base plate. This also allows clearance for intermediary plates to prevent them from accidental scuffing or tearing of the blank 11.

As shown in FIG. 6 with the apparatus base link 70, mounting bracket 73 and the distal link 86 removed for clarity, further movement of the links brings the intermediary plates into an overlapping position with the proximate plates so as to cause the blank inner side panels 21 to overlap the blank outer side panels 19 and the blank side base flaps 23 to be sandwiched between the intermediary plates and the base plate. The pawl 89 rests within the main link detent 90 to secure its position. The final positioning of the side folding mechanisms 44 forces the blank outer side panels 19 flushly against the proximal plates 51, with the adjoining corner webs 15 bowed inwardly as a result of the pressure exerted by the resilient projections 64.

Figure 7:
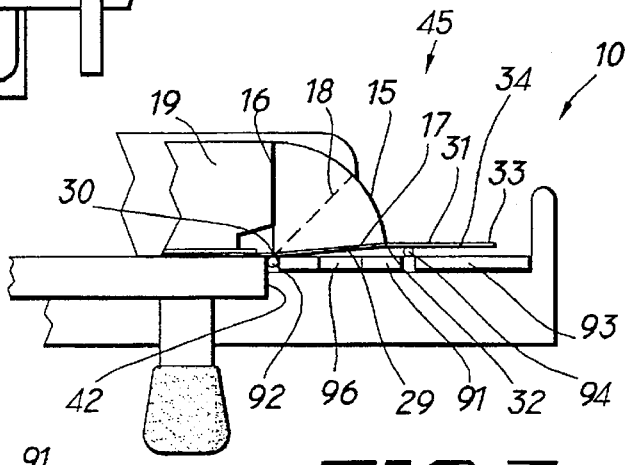
FIGS. 7–9 are a sequence of views of a portion of the apparatus of FIG. 1 which show, in sequence, a blank end panel being folded by the apparatus.
Figure 8:
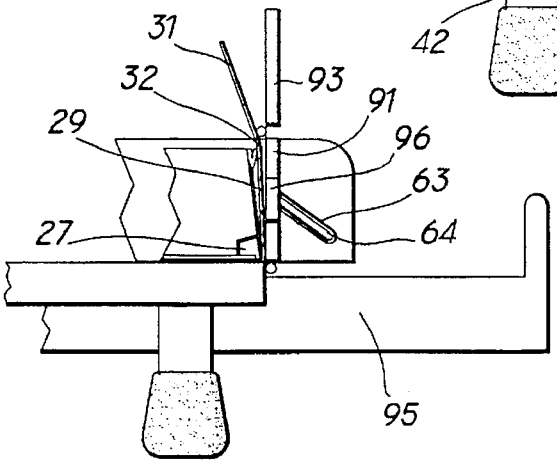
Figure 9:
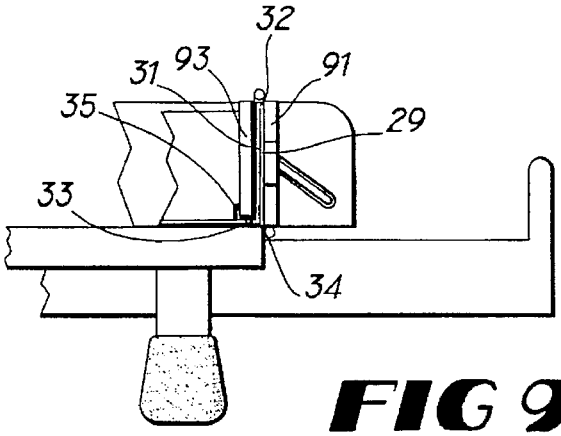

The end folding mechanisms 45 are then actuated by manually pivoting the proximal plate from their initial position, shown in FIGS. 1 and 7, upwards to a position substantially perpendicular to the base plate 40, as shown in FIG. 8. This action causes the corner webs 15 to be further bowed until they become folded along their fold lines 16, 17 and 18. The position of the inner side panels 21 causes the folded corner webs to be positioned against the outer end panels 29. The resiliency of the springs 64 allows the outer side panels to move past the springs without tearing. Also, springs 64 pass through notches 96 in the proximal plates 91 to allow the unobstructed passage thereby. As shown in FIG. 9, the distal plates 93 are then pivoted approximately 180° into an overlapping position with the proximal plates 91. This action folds the end panels 14 of the blank along fold lines 32 so that the inner end panels 31 overlap the outer end panels 29. This action also causes the end base flaps 33 to contact the central panel 12 and be folded about the distal plate along fold lines 34 as the distal plate 93 passes closes adjacent the base plate 40 thereby sandwiching the end base flaps 33 therebetween. The final positioning of the end base flaps causes their locking tabs 35 to be positioned within side notches 27, to prevent the unfolding of the blank and complete the erection of the box.

The end folding mechanisms and side folding mechanisms are then moved from their closed position to their open position to release the box by reversing the just described process.

It should be understood that the end folding mechanisms may be coupled to linkage similar to that described in reference to the side folding mechanisms. Also, the linkage may be actuated through a solenoid or the like, rather than handles, to automate the linkage of the apparatus.

From the foregoing, it is seen that apparatus for erecting boxes from blanks is now provided which overcomes problems associated with those of the prior art. It should however be understood that the just described embodiment merely illustrates principles of the invention in a preferred form. Many modifications, additions and deletions may, in addition to those expressly recited, be made without departure from the spirit and scope of the invention as set forth in the following claims.

We claim:

1. An apparatus for erecting boxes with double wall sides and base flaps from blanks having opposite side edges, opposite end edges, and opposite side panels with three spaced apart side score lines, said apparatus comprising;

a base having a top surface, oppositely disposed sides and oppositely disposed ends; and two side blank folding mechanisms mounted adjacent said base sides, each of said two side blank folding mechanisms having; a proximal side plate mounted for pivotal movement alongside said base; an intermediary side plate mounted for pivotal movement alongside said proximal side plate; a distal side plate including a catch means mounted for pivotal movement alongside said intermediary side plate; and actuating means for pivoting respectively said proximal side plate toward said base top surface, for pivoting said intermediary side plate toward said base top surface and into overlapped configuration with said proximal side plate, and for pivoting said distal side plate away from said intermediary side plate and said base top surface as said intermediary plate nears said proximal side plate, whereby upon placing the blank upon the base with said side edges captured by the catch means the blank sides are formed through operation of the actuating means by folding the blank along first side score lines as the proximal side plates move toward the base, by folding the blank along second side score lines so as to fold upon the blank portions between the first and second score lines as the intermediary side plates overlap the proximal side plates, and by folding the blank along third score lines to create a base flap as the intermediary side plates pass closely adjacent the base with the blank therebetween.

2. The apparatus of claim 1 wherein said catch means is provided by an elongated bar mounted adjacent the outer end edge of said distal plate and projecting upwardly when said side folding mechanisms are in open configuration.

3. The apparatus of claim 2 wherein said proximal side plate is hingedly mounted to said base and said intermediary side plate is hingedly mounted to said proximal side plate.

4. The apparatus of claim 1 further comprising two end blank folding mechanisms mounted adjacent said base ends, each of said end blank folding mechanisms having a proximal end plate mounted for pivotal movement alongside said base and a distal end plate mounted for pivotal movement alongside said proximal end plate, whereby blanks also having end panels with at least two end score lines are folded along their first end score lines as the proximal end plates move toward the base and are folded along their second end score lines as the distal end plates move toward said proximal end plates.

5. The apparatus of claim 4 wherein said proximal side plates have opposite ends and resilient projections mounted adjacent each said end of said proximal side plates, whereby blanks also having corner webs extending between the blank side panels and the blank end panels have their corner webs initially biased by the resilient projections.

6. The apparatus of claim 1 wherein said actuating means comprises a handle and a series of links operatively connecting said handle to said proximal side plate, said intermediary side plate and said distal side plate.

7. An apparatus for erecting boxes from blanks having opposite side panels, opposite end panels and corner webs extending between the side panels and the end panels, said apparatus comprising;

a base having a top surface, oppositely disposed side and oppositely disposed ends;

two end blank folding mechanisms mounted adjacent said base ends, each of said end blank folding mechanisms having a proximal end plate mounted for pivotal movements alongside said base and arranged to be pivoted into upright position;

two side blank folding mechanism mounted adjacent said base side, each of said two side blank folding mechanisms having: a proximal side plate mounted for pivotal movement alongside said base, an intermediary side plate hingedly mounted to said proximal side plate, a distal side plate hingedly mounted to said intermediary side plate, and means for sequentially pivoting said proximal side plate toward said base top surface and for pivoting said intermediary side plate toward said top surface and means for pivoting said distal plate away from said intermediary side plate;

and resilient projections mounted to said proximal side plates so as to project upwardly when said proximal side plates are in unfolded configuration;

whereby the corner webs of the blank when positioned between said side folding and end folding mechanisms are biased upwardly by said resilient projections as the sides of the blank are folded by the movement of said proximal side plates.

8. A method of erecting boxes with double side walls from a blank having opposite side edges, opposite end edges, and pairs of side wall panels joined to a central panel along side score lines, said method to be performed by means of an apparatus comprising a base having a top surface and oppositely disposed sides, and two blank folding mechanisms arranged adjacent said base sides, each of said blank folding mechanisms having a proximal side plate mounted for pivotal movement alongside said base; an intermediary side plate hinged to said proximal side plate; and a distal side plate hinged to said intermediary side plate and carrying a catch means adjacent the outer edge of said distal plate; the method comprising the steps of;

placing the blank to be set up between said opposed folding mechanisms so that opposed side edges of the blank are captured and restrained by said catch means;

causing the folding mechanisms to pivot towards one another to initiate folding of the side wall panels of the blank relative to the central panel such that the side edges of the blank are released by said catch means when said adjacent side wall panels are moving toward each other; and continuing said folding of the side wall panels until they are put into overlapping relationship.

9. An apparatus for setting up boxes with double side walls from a flat blank having opposed side edges and opposed end edges and comprising a central panel defined by opposed side score lines and opposed end score lines and at least a pair of side panels joined to the central panel along each of said side score lines, said apparatus comprising;

a base having a top surface, and blank folding means for setting up each of the side walls of the blank in double ply form, each of said blank folding means comprising; a proximal side plate mounted for pivotal movement adjacent said base, an intermediary side plate mounted for pivotal movement alongside said proximal side plate, a distal side plate mounted for pivotal movement with respect to said intermediary side plate, catch means associated with said distal side plate for engaging opposed side edges of the blank during initial setting up of said side walls, and actuating means for pivoting said proximal side plate, said intermediary side plate, and said distal side plate toward said top surface of the base and into overlapping relationship with one another, whereby said catch means are caused to release said opposed side edges of said blank while said adjacent side panels are moving into overlapping relationship with one another thereby to allow said adjacent side panels to be put into overlapping relationship.

* * * * *